US008367185B1

(12) United States Patent
Kay

(10) Patent No.: US 8,367,185 B1
(45) Date of Patent: Feb. 5, 2013

(54) STICKY MOSAIC ART KIT

(76) Inventor: Steven Kay, Halifax (CA)

( * ) Notice: Subject to any disclaimer, the term of this patent is extended or adjusted under 35 U.S.C. 154(b) by 1263 days.

(21) Appl. No.: 11/337,133

(22) Filed: Jan. 19, 2006

(51) Int. Cl.
*B32B 3/24* (2006.01)

(52) U.S. Cl. ..... 428/138; 446/118

(58) Field of Classification Search ..... 428/138; 446/118
See application file for complete search history.

(56) References Cited

U.S. PATENT DOCUMENTS 4,011,676 A * 3/1977 Ritter ..... 40/622
4,139,667 A * 2/1979 Blue ..... 428/38
4,243,453 A * 1/1981 McClintock ..... 156/152
4,767,119 A * 8/1988 Fadner et al. ..... 273/148 A
4,814,218 A * 3/1989 Shane ..... 428/102
4,891,030 A * 1/1990 Gertzfeld ..... 446/118
4,993,984 A * 2/1991 Matarese ..... 446/118
5,306,374 A * 4/1994 Hambright ..... 156/247
5,555,163 A * 9/1996 Pisani ..... 362/244
6,800,012 B2 * 10/2004 Maxim ..... 446/219

* cited by examiner

*Primary Examiner* — William P Watkins, III
(74) *Attorney, Agent, or Firm* — Bert P. Krages

(57) ABSTRACT

An art kit having a template, preferably with a pre-printed design defined by specifically positioned squares and a plurality of polygonal monochromatic tiles of various colors is provided. The pre-printed design has a numerical grid formed thereon which corresponds to a legend for positioning particular colors of tiles in particular locations to complete the intended artwork. This artwork can be framed and hung when completed. Optionally, the template may be formed of transparent material for backlighting purposes, have a hole pattern to accommodate positioning of lamps in a particular array, or be formed on an item of clothing and made permanent through the application of heat.

3 Claims, 3 Drawing Sheets

STICKY MOSAIC ART KIT

BACKGROUND AND SUMMARY OF THE INVENTION

The present invention is directed to the field of educational toys. More particularly, the present invention is directed to a kit including a template and sticky-backed mosaic tiles which a child can employ to create a work of art.

Mosaics is an ancient art form dating back at least five centuries before the birth of Christ. The present invention seeks to involve kids in the creating of a mosaic work of art and to do it in a way that is fun. The present invention comprises a kit having a template, preferably with a pre-printed pattern and a plurality of polygonal tiles having a variety of colors on at least one side thereof; pressure-sensitive adhesive coated on at least one of the template and a rear surface of each of said plurality of tiles; whereby said plurality of polygonal tiles can be assembled into a desired pattern to form a mosaic art work. Preferably, at least some of the polygonal tiles are square and most preferably, all of the tiles are formed as monochromatic squares. Preferably, both of the template and the rear surface of each of the plurality of tiles is coated with a pressure-sensitive adhesive.

In an alternative embodiment, at least some of the polygonal tiles are bejeweled so as to sparkle. It is further envisioned that the template can comprise a plurality of apertures for receiving light such that the completed mosaic art work can be back lit causing the bejeweled tiles to sparkle. The material of choice for the tiles is selected from a group consisting of vinyl, ethylene vinyl acetate foam, cardboard, styrene, acrylic and cloth. In still a further embodiment, the template comprises a garment with a stenciled pattern for receiving a plurality of colored tiles. The pressure-sensitive adhesive holds the tiles in place until the color can be permanently transferred to the garment by the application of heat, as with an iron, for example.

Various other features, advantages, and characteristics of the present invention will become apparent after a reading of the following detailed description.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF PREFERRED EMBODIMENT(S)

Figure 1:
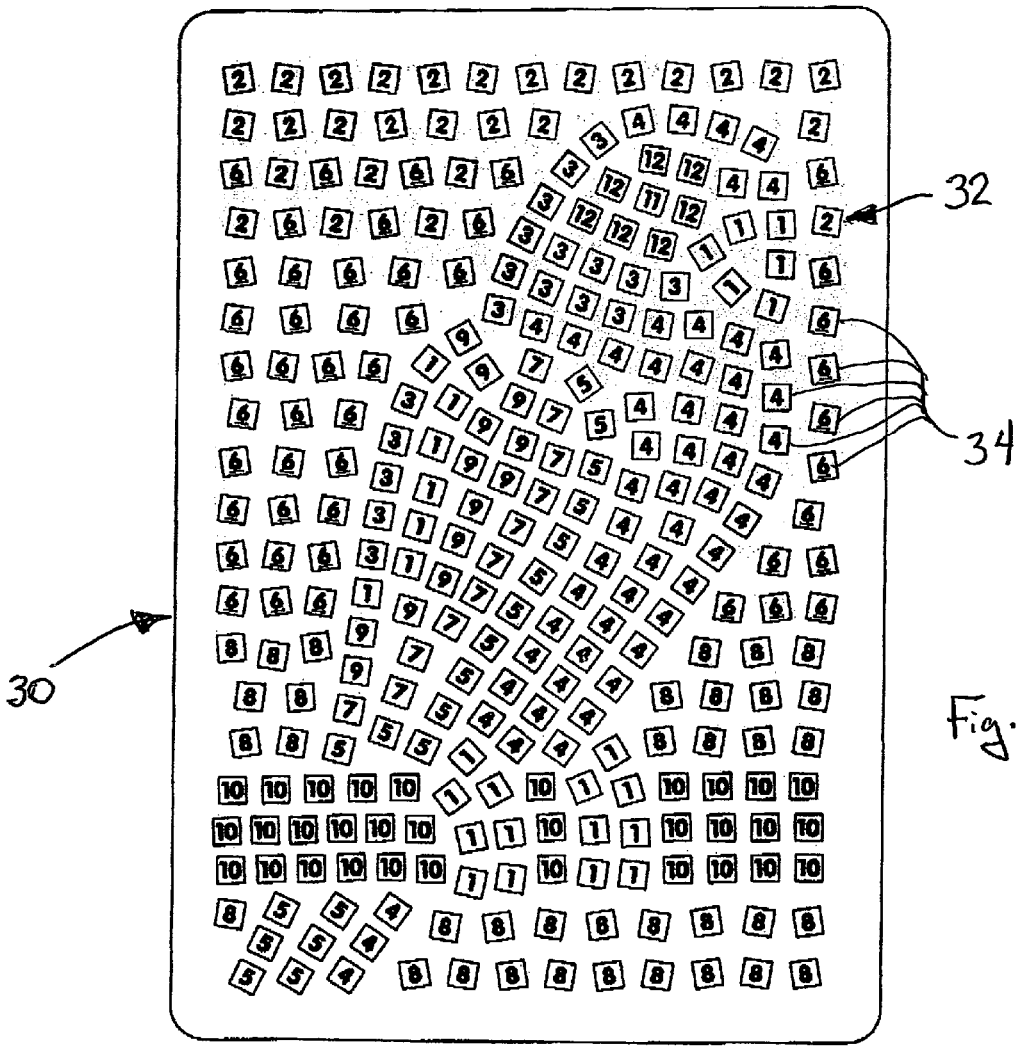
FIG. 1 is a front view of a first embodiment of an exemplary template used as part of the present invention.
Figure 2:
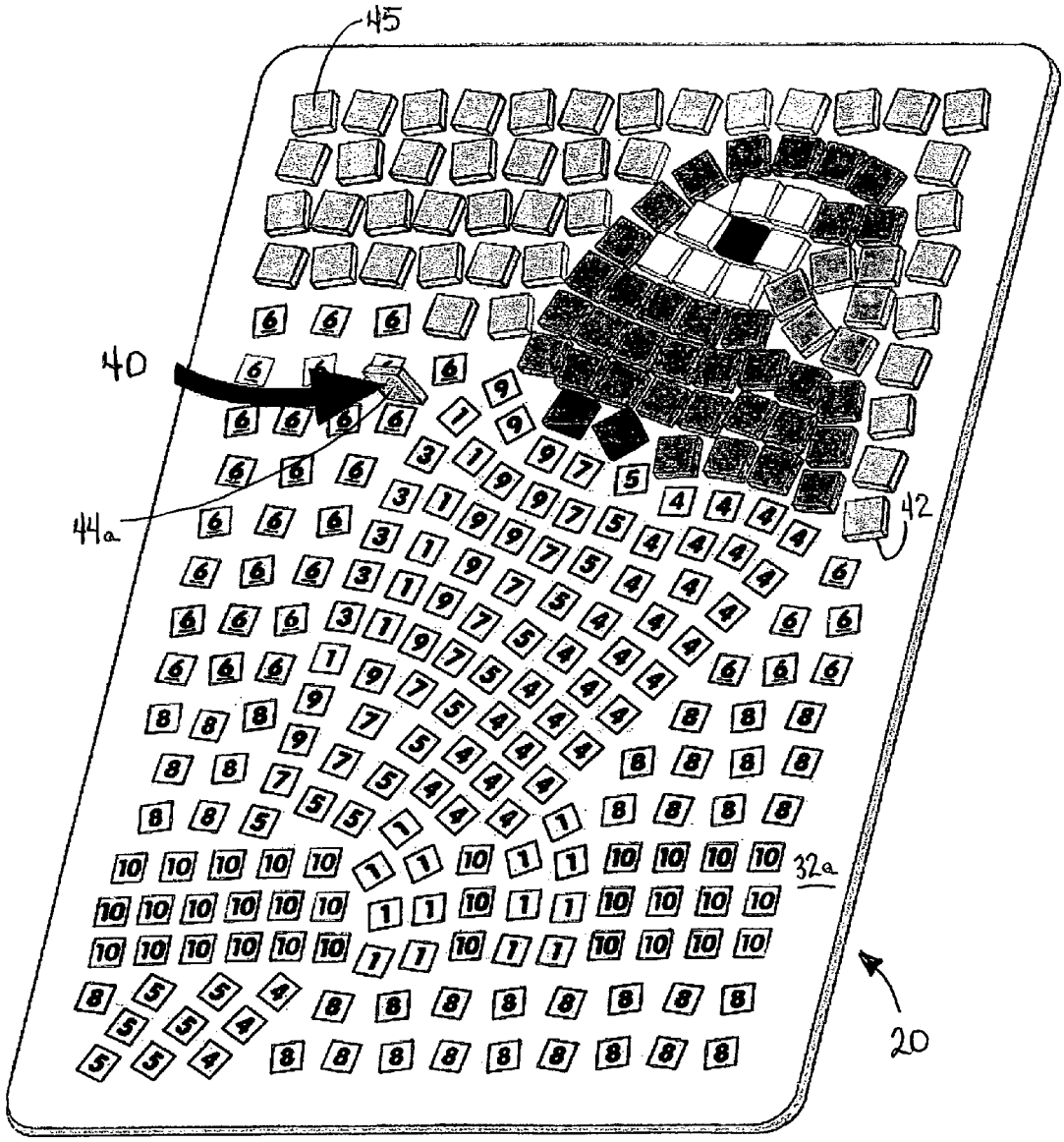
FIG. 2 is a front perspective view of a partially completed artwork using the template and tiles of the first embodiment; and, FIG. 3 is a perspective view showing the completed artwork shown in FIGS. 1 and 2.
Figure 3:
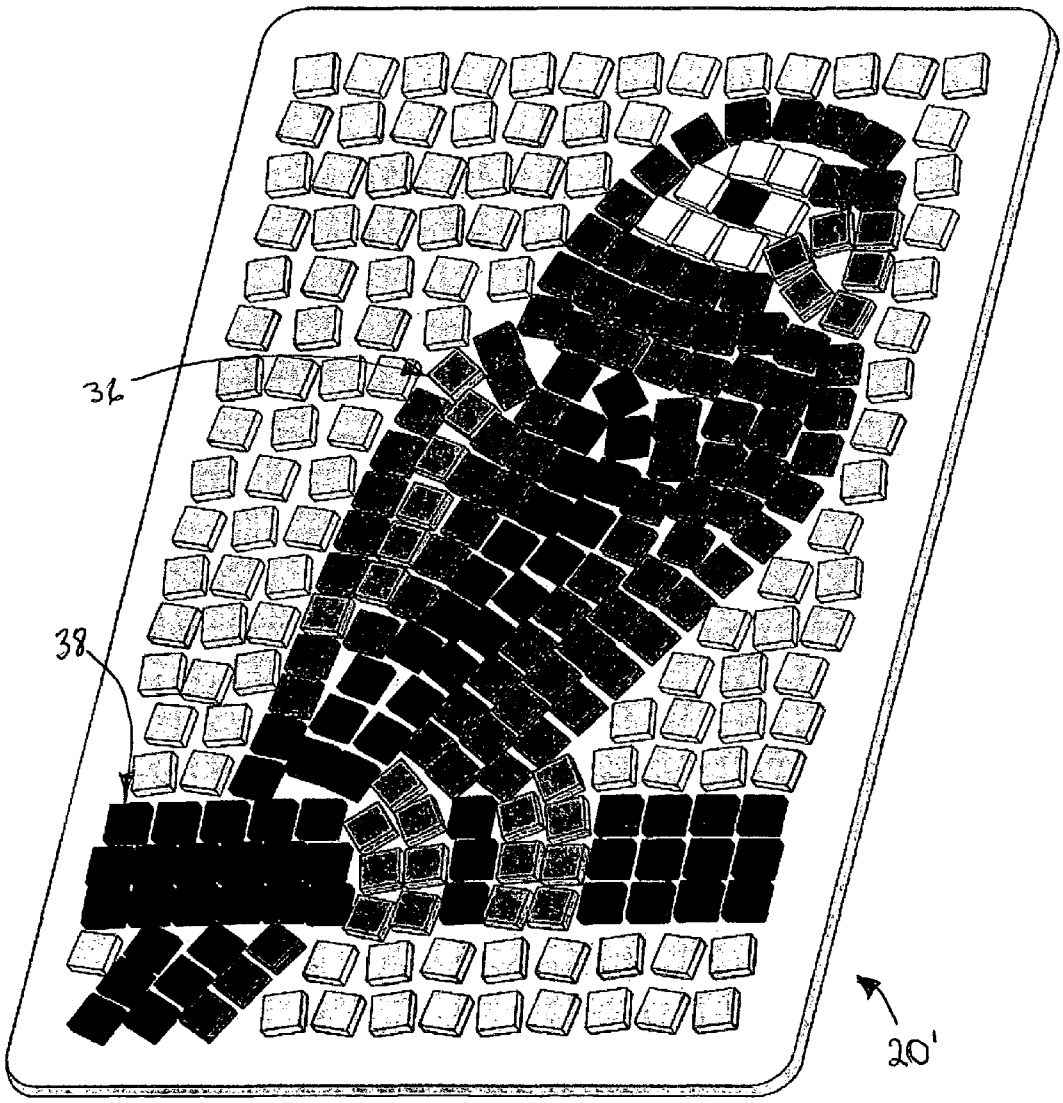

A first embodiment of the sticky mosaic kit of the present invention is shown in FIG. 2 generally at 20. Kit 20 comprises a template 30 preferably having a printed pattern 32 thereon. As depicted in FIG. 1, template 30 has a preprinted pattern 32 formed by numbered squares 34 positioned to form the image of a parrot 36 sitting on a branch 38 (FIG. 3). Obviously, the preprinted pattern 32 can take various forms to numerous to enumerate. The numbers on squares define a legend for attachment of tiles 40 (FIG. 2). Tiles 40 may be constructed of materials selected from a group consisting of vinyl, ethylene vinyl acetate foam, cardboard, and cloth. Tiles 40 are preferably monochromatic, that is, each the has a particular individual color according to a legend as follows.

| | | | | | |
|---|---|---|---|---|---|
| 1-yellow | 2-pink | 3-orange | 4-red | 5-violet | 6-blue |
| 7-purple | 8-lime | 9-green | 10-brown | 11-black | 12-white |

This legend is merely exemplary. Obviously, other number schemes and hues can be employed without departing from the scope of the invention. At least one, and preferably both, of the surface of template 30 and the rear surface 42 of tiles 40, are coated with a pressure-sensitive adhesive 30*a* and 44*a*. When the properly colored tile 40 is located over the appropriate numbered square 34, pressure to the front surface of tile 40 will secure it in place on template 30. When the mosaic art work 20 is complete, as depicted in FIG. 3, it may be framed and hung on the wall.

Template 30 is preferably is made of paper, although it may be constructed of a clear plastic to enable a string of lights (not shown) or a Litebrite™ light source to be positioned behind template 30 for purposes of back lighting. Additionally, the artwork could be configured as a "light catcher" and the backlighting provided by sunlight. Back-lighting is most effective when transparent or translucent tiles, preferably made of styrene or acrylic, which are bejeweled are employed. In such situations, the template may, alternatively, employ a hole pattern where particular bulbs are to be situated to illuminate such jeweled tiles causing them to sparkle.

Template 30 shown in FIG. 1 may be a stencil on a garment such as a t-shirt, jacket, or the like. In such an embodiment, the tiles are preferably vinyl with a layer of pigment located between upper surface 45 of tile 40 and the layer 44*a* of pressure-sensitive adhesive. Adhesive layer 44*a* will secure the tiles in place until the location of tiles 40 can be made permanent through the application of heat by means of, for example, an iron. In this embodiment, the vinyl portion of tiles 40 may be designed to melt (vaporize), remain in tact, or be removed, without departing from the scope of the invention. The garment will have a resulting mosaic artwork 20' affixed thereto.

Various changes, alternatives and modifications will become apparent to one of ordinary skill in the art following a reading of the foregoing specification. For example, the mosaic of the present invention could be formed on a three-dimensional object such as a mug, jewelry box, light shade, or the like. It is intended that any such changes, alternatives and modifications as fall within the scope of the appended claims be considered part of the present invention.

I claim:

1. A kit for creating a work of art comprising:

a) a template:

b) a plurality of polygonal tiles having a variety of colors on at least one side thereof, wherein at least some of said polygonal tiles are bejeweled so as to sparkle;

c) pressure-sensitive adhesive coated on at least one surface of said template and a rear surface of each of said plurality of tiles;

d) wherein said template further comprises a plurality of apertures for receiving light to backlight the completed mosaic art work causing said bejeweled tiles to sparkle;

whereby said plurality of polygonal tiles can be assembled into a desired pattern to form a mosaic art work;

e) wherein said template further comprises a plurality of lights situated according to the pattern of said apertures, and said template includes a pre-printed pattern which is coded to receive a particular one of said variety of colors at a particular location on said template.

2. A kit for creating a work of art comprising:

a) a template:

b) a plurality of polygonal tiles having a variety of colors on at least one side thereof, wherein at least some of said polygonal tiles are bejeweled so as to sparkle;

c) pressure-sensitive adhesive coated on at least one surface of said template and a rear surface of each of said plurality of tiles;

(d) wherein said template further comprises a plurality of apertures for receiving light to backlight the completed mosaic art work causing said bejeweled tiles to sparkle;

whereby said plurality of polygonal tiles can be assembled into a desired pattern to form a mosaic art work;

e) wherein said template further comprises a plurality of lights situated according to the pattern of said apertures.

3. A kit for creating a work of art comprising:

a) a template:

b) a plurality of polygonal tiles having a variety of colors on at least one side thereof;

c) pressure-sensitive adhesive coated on either one surface of said template or coated on a rear surface of each of said plurality of tiles;

d) said template includes a pre-printed pattern which is coded to receive a particular one of said variety of colors at a particular location on said template;

e) wherein at least more than one of said polygonal tiles are bejeweled so as to sparkle; and f) a plurality of apertures for receiving light to backlight the completed mosaic art work causing said bejeweled tiles to sparkle and a plurality of lights situated according to the pattern of said apertures;

whereby said plurality of polygonal tiles can be assembled into a desired pattern to form a mosaic art work.

* * * * *